US005687921A

United States Patent [19]

Moreels

[11] Patent Number: 5,687,921

[45] Date of Patent: Nov. 18, 1997

[54] REDUCING APPARATUS

[75] Inventor: Luc Moreels, Zingem, Belgium

[73] Assignee: De Pecker N.V., Gent, Belgium

[21] Appl. No.: 583,647

[22] Filed: Jan. 5, 1996

[30] Foreign Application Priority Data

Jan. 6, 1995 [EP] European Pat. Off. ..... 9520024

[51] Int. Cl.[6] ..... B02C 18/00

[52] U.S. Cl. ..... 241/86.1; 241/88.1; 241/89.1; 241/89.3; 241/95; 241/99; 241/240; 241/285.3

[58] Field of Search ..... 83/403, 509, 856, 83/915.3; 241/86.1, 88.1, 89.1, 89.3, 95, 224, 240, 241, 242, 93, DIG. 38, DIG. 17, 99, 285.1, 285.2, 285.3

[56] References Cited

U.S. PATENT DOCUMENTS

| | | | |
|---|---|---|---|
| 2,195,879 | 4/1940 | Urschel et al. | 83/403 |
| 2,961,024 | 11/1960 | Urschel et al. | 83/403 |
| 3,353,755 | 11/1967 | Zimmermann . | |
| 3,989,196 | 11/1976 | Urschel | 241/88.1 X |
| 4,055,099 | 10/1977 | Mitsubayashi | 241/95 X |
| 4,648,296 | 3/1987 | Wisdom et al. | 83/403 X |
| 4,858,834 | 8/1989 | Lanham | 241/86.1 X |
| 4,972,888 | 11/1990 | Dean | 241/89.3 X |

FOREIGN PATENT DOCUMENTS

| | | | |
|---|---|---|---|
| 0220100 | 4/1987 | European Pat. Off. . | |
| 2153236 | 5/1973 | Germany . | |
| 2827349 | 1/1980 | Germany . | |
| 416287 | 10/1934 | United Kingdom . | |
| 651920 | 4/1951 | United Kingdom | 241/93 |
| 1292493 | 10/1972 | United Kingdom . | |

*Primary Examiner*—Mark Rosenbaum
*Attorney, Agent, or Firm*—Webb Ziesenheim Bruening Logsdon Orkin & Hanson, P.C.

[57] ABSTRACT

The invention relates to a device for shredding plastic objects [(2)], provided with a spiral-shaped housing [(3)] in which a carrier member [(4)] is rotatably mounted. The housing [(3)] has an opening [(8)] arranged in its upper surface [(5)] for feeding objects [(2)] for shredding and an opening [(9)] arranged in its side surface [(7)] for discharging shredded material [(10)]. The discharge opening [(9)] is herein bounded by a cutting edge [(11)] and the carrier member [(4)] has a number of anvils [(12)] co-acting with the cutting edge [(11)].

17 Claims, 3 Drawing Sheets fig.2
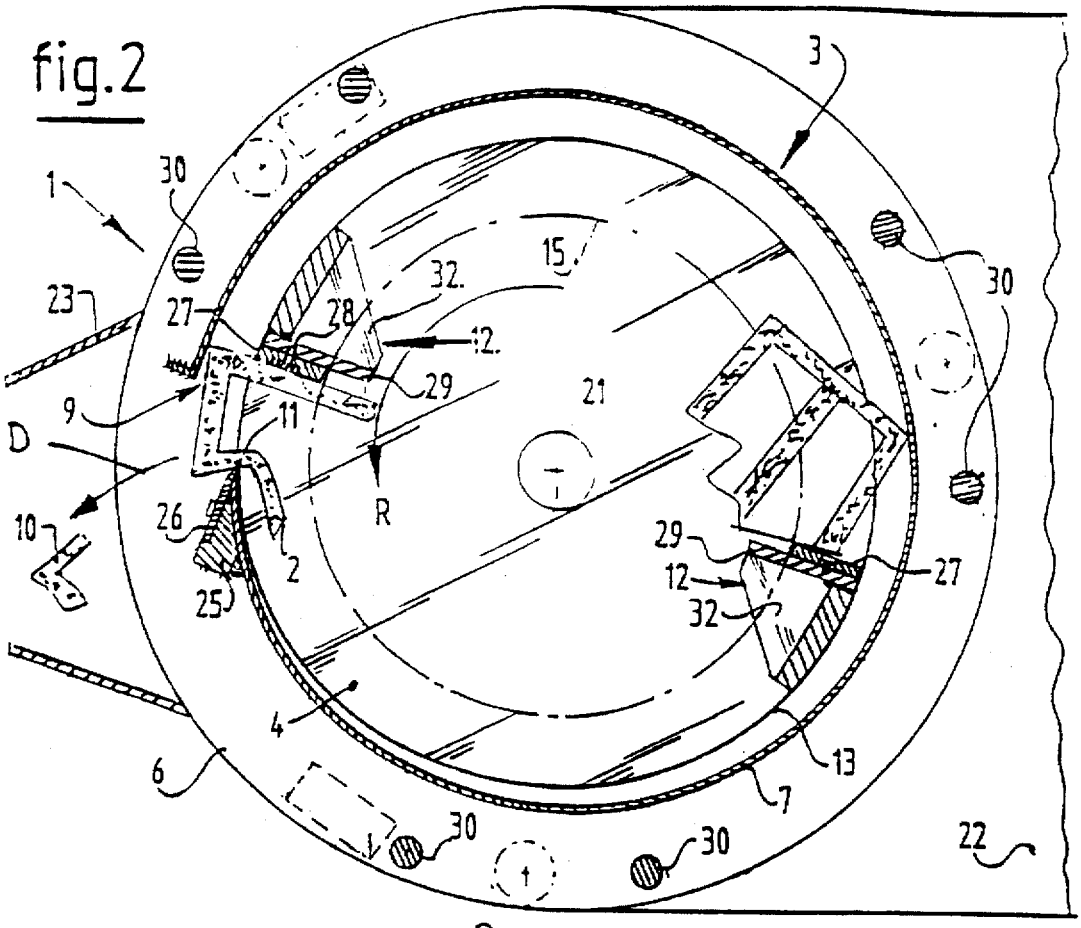
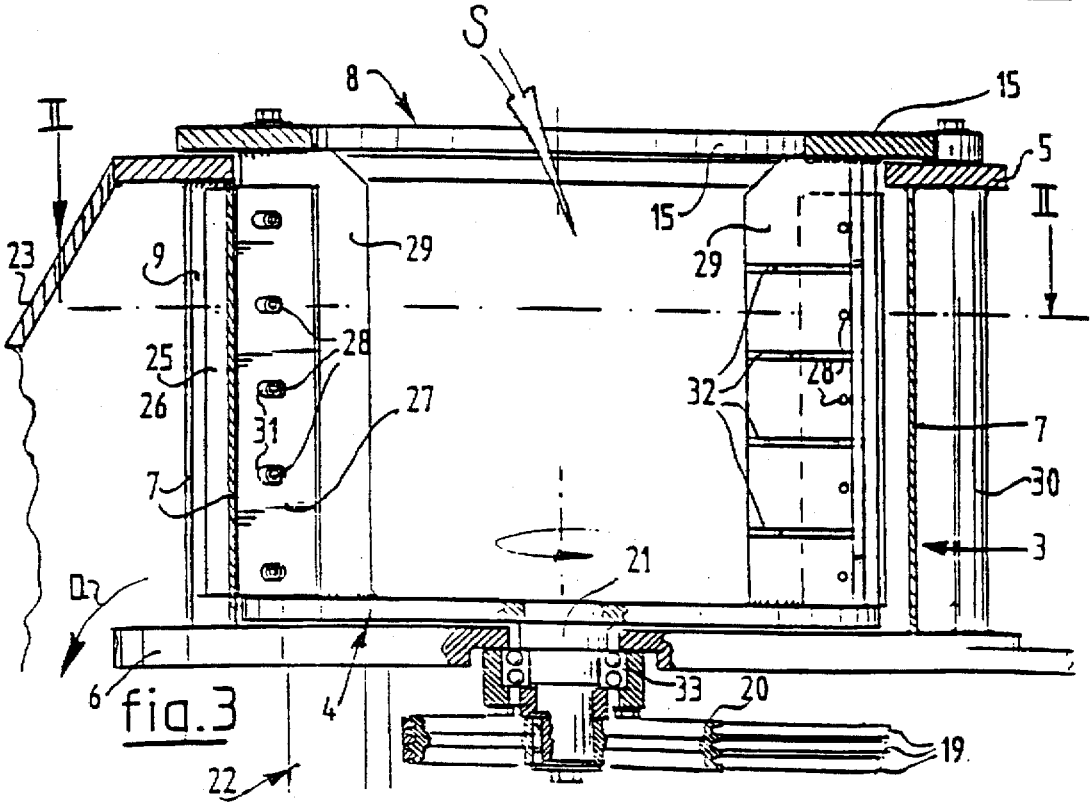
fig.3

REDUCING APPARATUS

BACKGROUND OF THE INVENTION

The invention relates to a device for reducing in size of particularly plastic objects. Such devices are already generally known and are often designated with the collective name of "shredders".

SUMMARY OF THE INVENTION

The invention has for its object to provide a shredding device with a decreased energy consumption and increased level of performance relative to the known devices. To this end the invention provides a device for shredding particularly plastic objects, provided with a substantially cylindrical housing in which at least one carrier member is rotatably mounted, wherein the housing has at least one opening arranged in one of its end surfaces for feeding objects for shredding and at least one opening arranged in its side surface for discharging shredded material, which discharge opening is bounded by cutting edge. In this device the products for shredding, after having been placed into the housing through the feed opening, are urged to the outside of the housing by the centrifugal force resulting from the rotation of the carrier member and subsequently pressed against the cutting edge of the discharge opening and thereby shredded. As a result of the movement of air in the housing the shredded material is ejected with force from the housing through the discharge opening. A clean cutting action is thus obtained whereby the energy required for the shredding is minimal and the performance level of the device maximal.

BRIEF DESCRIPTION OF THE DRAWINGS

Preferred embodiments of the shredding device according to the invention form the subject-matter of the dependent claims. The invention is now elucidated on the basis of two embodiments, wherein reference is made to the annexed drawing, in which:

FIG. 2 shows a cross section through the device along the line II—II in FIG. 3, FIG. 3 shows a longitudinal section through the shredding device depicted in FIG. 1.

DESCRIPTION OF THE PREFERRED EMBODIMENT

Figure 1:
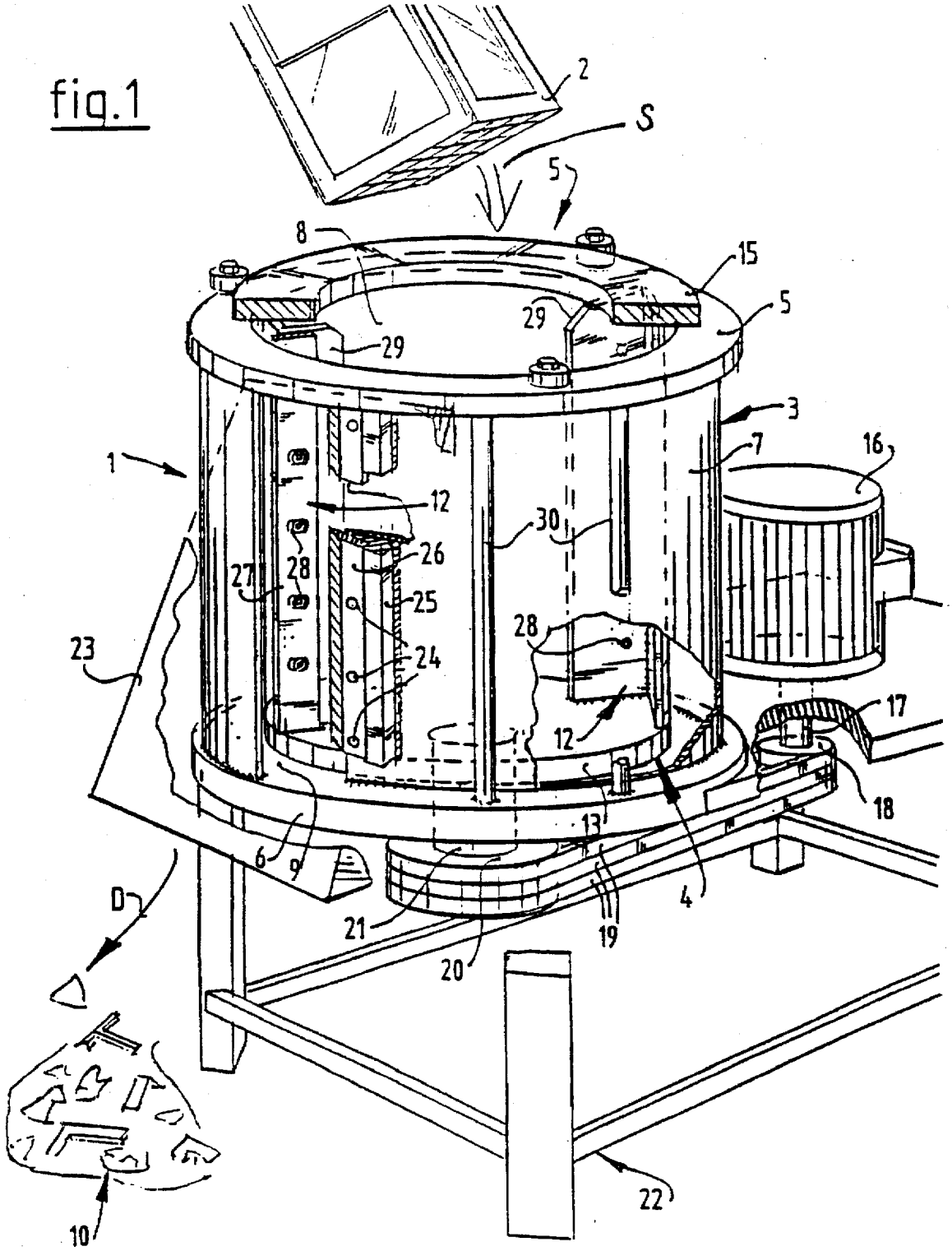
FIG. 1 shows a partly cut away perspective view of a first embodiment of the shredding device according to the invention.
Figure 4:
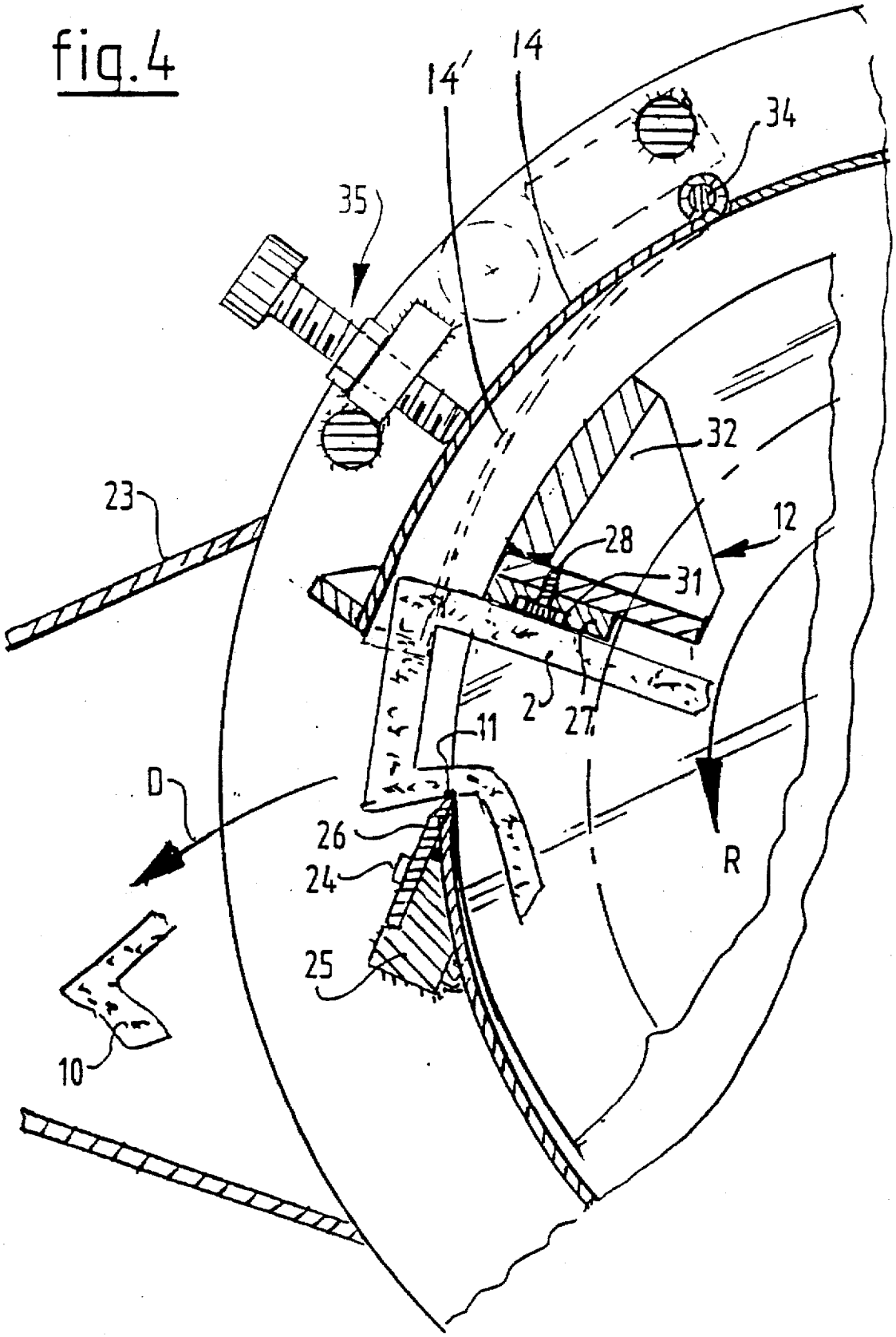
FIG. 4 shows a detail section corresponding with FIG. 2 of an alternative embodiment of the device according to the invention.

A device 1 for shredding objects 2, in particular hollow plastic articles, is provided with a substantially cylindrical housing 3 in which a carrier member 4 is rotatably mounted. The housing 3 is formed by an upper surface 5, a lower surface 6 end a substantially cylindrical side surface 7. The upper surface 5 and the lower surface 6 are further connected by a number of mutually spaced strengthening rods 30. Arranged in the upper surface 5 is a feed opening 8 bounded by a ring 15 to receive the objects 2 for shredding. In addition, the housing 3 has in its side wall 7 a discharge opening 9 for shredded material 10 which is bounded by a cutting edge 11. Discharge opening 9 is slit-shaped and runs parallel to a generating line of the side wall. The discharge opening 9, which covers practically the whole height of housing 3, is formed by the housing 3 taking the form of a spiral with a diameter which increases from the cutting edge 11 in the rotation direction R of carrier member 4. The discharge opening 9 is covered by a hood 23 which intercepts the shredded material 10 flung with force out of housing 3.

The carrier member 4 is formed by a circular supporting disc 13 on which two anvils 12 are arranged with equal interspacing. Carrier member 4 has on its underside a shaft 21 on which a pulley 20 is arranged and driven rotatably by a motor 16, the output shaft 17 of which is likewise provided with a pulley 18. Three drive belts 19 stretch between the two pulleys 18, 20. Like housing 3, motor 16 is arranged on a support frame 22.

The anvils 12 are each substantially L-shaped in cross section and provided on their leading surface 29 as seen in rotation direction R with an exchangeable stop strip 27 fastened by bolts 28. The bolts 28 are received in slot-like apertures 31 of the striker strip 27, whereby the position of striker strip 27 can be varied relative to the leading surface 29.

In order to enable simple replacement of the cutting edge 11 in the case of wear, this edge is formed by a replaceable cutting blade 26 which is fastened by means of bolts 24 to a receiving block 25 connected to the side wall 7 of the housing.

The objects 2 for shredding are thrown as according to arrow 8 into the feed opening 8 on the top side of housing 3, whereafter they are urged toward the side wall 7 of the housing by the centrifugal force acting in housing 3 as a result of the rotation of the carrier member 4. They are herein carried along the wall 7 by the anvils 12 of carrier member 4. As stated, the wall 7 has a spiral-shaped progression (FIG. 2) with a diameter which increases from the cutting edge 11 in the rotation direction R. The slit-like aperture 9 is hereby defined between the cutting wall 11 and the end of the wall 7 located opposite. The objects 2 for shredding are urged along wall 7 by anvils 12 until they reach cutting edge 11, whereafter through co-action between the cutting edge 11 and the striker strip 27 of anvil 12 a portion of the objects 2 for shredding is severed and ejected as shredded material 10 from housing 3 in the direction of arrow D. In this manner a clean and very efficient cutting movement is effected, whereby a uniform shredding of objects 2 is achieved with minimal energy consumption.

The dimensions of the shredded material 10 are ultimately determined by the passage opening of the discharge 9. If it is desired to reduce the material to different sizes, the discharge opening 9 can make an adjustable form. For this purpose the outer wall part 14 which bounds opening 9 can take a hinged form and be connected to a screw adjustment mechanism 35. The wall part 14 can thus be pivoted round a pivot shaft 34 between for instance the position shown in full lines and the position 14' shown in dashed lines in order to adjust the desired discharge opening 9.

Although the invention is described above in relation to shredding of hollow plastic objects, it will be apparent to the skilled person that other materials can also be shredded. The carrier member 4 can also be provided with more than two anvils which, in order to obtain uniform running of the device, must preferably be arranged at equal mutual angular distances. It is optionally also possible to arrange more than one discharge opening in the wall, or to divide the discharge opening in height direction with horizontal blades. Finally, the device, which in the illustrated embodiment is shown in standing position, can also be placed in lying position as long as the rotation speed of carrier member 4 is sufficient to urge the objects for shredding to the spiral-shaped wall by centrifugal force.

I claim:

1. A shredding device for shredding objects, comprising a housing, a carrier member rotatably mounted in the housing, at least one feed opening arranged in one end surface of the housing for feeding objects for shredding and at least one discharge opening arranged in a side wall of the housing for discharging shredded material, wherein:

said discharge opening is bounded by a cutting edge;

said discharge opening extends substantially parallel to a generating line of said side wall over substantially a whole length thereof; and said housing has a spiral form with a diameter which increases from said cutting edge of the discharge opening in a rotation direction of said carrier member.

2. The shredding device as claimed in claim 1, wherein said carrier member includes at least one anvil that is co-acting with the cutting edge.

3. The shredding device as claimed in claim 2, wherein said carrier member includes a plurality of anvils which are arranged at corresponding mutual angular distances on a supporting disc.

4. The shredding device as claimed in claim 3, wherein said discharge opening is adjustable.

5. The shredding device as claimed in claim 4, wherein at least one part of said side wall bounding the discharge opening is pivotable.

6. The shredding device as claimed in claim 5, wherein said housing extends substantially vertically and said feed opening is arranged in an upper surface of said housing.

7. The shredding device as claimed in claim 1, wherein said carrier member includes at least one anvil that is co-acting with the cutting edge.

8. The shredding device claimed in claim 7, wherein said carrier member includes a plurality of anvils which are arranged at corresponding mutual angular distances on a supporting disc.

9. A shredding device for shredding objects, comprising a housing, a carrier member rotatably mounted in the housing, at least one feed opening arranged in one end surface of the housing for feeding objects for shredding and at least one discharge opening arranged in a side wall of the housing for discharging shredded material, wherein:

said discharge opening is bounded by a cutting edge; and said housing has a spiral form with a diameter which increases from said cutting edge of the discharge opening in a rotation direction of said carrier member.

10. The shredding device as claimed in claim 9, wherein said carrier member includes at least one anvil that is co-acting with the cutting edge.

11. The shredding device claimed in claim 10, wherein said carrier member includes a plurality of anvils which are arranged at corresponding mutual angular distances on a supporting disc.

12. The shredding device as claimed in claim 11, wherein said discharge opening is adjustable.

13. The shredding device as claimed in claim 9, wherein said discharge opening is adjustable.

14. The shredding device as claimed in claim 13, wherein at least one part of said side wall bounding the discharge opening is pivotable.

15. The shredding device as claimed in claim 12, wherein at least one part of said side wall bounding the discharge opening is pivotable.

16. The shredding device as claimed in claim 15, wherein said housing extends substantially vertically and said feed opening is arranged in an upper surface of said housing.

17. The shredding device as claimed in claim 9, wherein said housing extends substantially vertically and said feed opening is arranged in an upper surface of said housing.

* * * * *